United States Patent [19]

Tsukada et al.

[11] Patent Number: 4,745,763

[45] Date of Patent: May 24, 1988

[54] METHOD FOR PRODUCTION OF COMPRESSION-SOLIDIFIED SNOW

[75] Inventors: Hisashi Tsukada; Takahiro Abe; Sugio Ishihara; Junichi Taira; Hiroo Akabane, all of Hokkaido, Japan

[73] Assignee: The Japan Steel Works, Ltd., Tokyo, Japan

[21] Appl. No.: 105,755

[22] Filed: Oct. 8, 1987

Related U.S. Application Data

[62] Division of Ser. No. 26,360, Mar. 16, 1987.

[30] Foreign Application Priority Data

Mar. 14, 1986 [JP] Japan ..... 61-55127
Apr. 30, 1986 [JP] Japan ..... 61-100070

[51] Int. Cl.[4] ..... F25C 1/00
[52] U.S. Cl. ..... 62/66; 62/75
[58] Field of Search ..... 62/12, 35, 66, 76, 75, 62/341

[56] References Cited

U.S. PATENT DOCUMENTS 2,151,855 3/1939 Kobold ..... 62/35
2,565,245 8/1951 Lebovitz ..... 62/341
2,921,444 1/1960 Bump et al. ..... 62/341
2,927,439 3/1960 Polk ..... 62/341
3,685,309 8/1972 Harza ..... 62/341
3,858,485 1/1975 Rosaen et al. ..... 92/108
4,412,852 1/1983 Umino et al. ..... 62/341

*Primary Examiner*—Ronald C. Capossela
*Attorney, Agent, or Firm*—Sughrue, Mion, Zinn, Macpeak, and Seas

[57] ABSTRACT

An apparatus for production of compression-solidified snow comprises a pressure chamber with a rust preventive inner face, a pressure head for applying pressure to snow, a boost-typed pressure cylinder installed at one end of the pressure chamber and equipped with the pressure head, a hopper having an inner face which allows snow to slide thereon smoothly, and a pusher installed in a snow compression zone at the other end of the pressure chamber. A method of compressing snow into solidified snow lump is characterized in that snow having a temperature of 0° to −30° C. is compressed and formed with a pressure of 10 to 200 kg/cm$^2$ at a head displacement velocity of 0.1 to 150 mm/sec for pressure holding time of 0–300 seconds into a solid having a density of 0.6 g/cm$^3$ or more.

1 Claim, 6 Drawing Sheets

FIG. 10

| NO. | SNOW TEMP. | PRESSURE | PRESSING SPEED | HOLDING TIME | SNOW LUMP SIZE | WEIGHT | DENSITY |
|---|---|---|---|---|---|---|---|
| 1 | 0°C | 20 kg/cm$^2$ | 1.23mm/sec | 40sec | 10 x 10 x 7 cm | 610g | 0.88 |
| 2 | −13°C | 100 kg/cm$^2$ | 0.70mm/sec | 0.5sec | 10 x 10 x 10 cm | 870g | 0.87 |
| 3 | −24°C | 60 kg/cm$^2$ | 10mm/sec | 30sec | 10 x 10 x 6 cm | 440g | 0.72 |
| 4 | −30°C | 150 kg/cm$^2$ | 1.23mm/sec | 30sec | 10 x 10 x 7 cm | 610g | 0.87 |
| 5 | −1°C | 60 kg/cm$^2$ | 3.5mm/sec | 30sec | 30x30x27 cm | 21500g | 0.88 |
| 6 | −5°C | 100 kg/cm$^2$ | 1.7mm/sec | 180sec | 30x30x60cm | 49100g | 0.91 |

(ROOM TEMP. 3°C)

METHOD FOR PRODUCTION OF COMPRESSION-SOLIDIFIED SNOW

This is a Division of application Ser. No. 026,360, filed Mar. 16, 1987.

BACKGROUND OF THE INVENTION

The present invention relates to an apparatus and a method for production of compression-solidified snow, wherein snow is compressed and solidified into ice lumps for convenience of conveyance, storage and utilization of snow.

The thermal energy of snow has been hardly utilized in snowy districts. As a matter of fact, snow is still treated as a useless or otherwise obstructive thing which is likely to cause a traffic obstacle and thus obstructive to everyday life.

In other words, not only a great deal of time but also an enormous amount of money is required to remove and discharge snow and, because of its low density, the snow removal and discharge efficiency is extremely low, whereby it has become difficult to secure snow dumping grounds in urban areas.

Japanese Patent Applications (OPI) Nos. 108383/79 and 203376/83, for instance, disclose methods of compressing and solidifying snow to facilitate snow removal and discharge convenience. In the case of the former, snow is compressed and solidified so that it may be sent under pressure through transport pipes by means of air, whereas in the case of the latter, a compressor is employed to compress and solidify snow so as to store the product in a tank.

As aforesaid, there have been proposed various kinds of the apparatus for compressing and solidifying snow, using a piston-typed cylinder as a pressure cylinder for pressing snow. However, in the conventional apparatus using such a piston-typed pressure cylinder, it is necessary to increase the capacity of an oil pressure pump and the capacity of a motor in order to increase a rate of pressure application, thereby to improve productivity. This causes the result opposite to the purpose of energy saving attempted by utilizing the thermal energy of compression-solidified snow.

Further, the conditions of compression required for compressing and solidifying snow have been indicated by neither Patent Application aforesaid and the problem is that no actual conditions of snow solidification for the purposes of transportation and storage have been made clear. Unless snow has been solidified to a satisfactory density, for instance, the lump will be broken during transportation or unfit for effective storage.

SUMMARY OF THE INVENTION

The present invention is intended to solve the above problems and it is therefore an object of the invention to provide an apparatus for forming snow into compression-solidified ice lumps to facilitate the thermal utilization of the ice lumps and snow removal and discharge convenience.

Another object of the present invention is to provide an apparatus for forming snow into compression-solidified ice lumps to control snow compression force, the apparatus being provided with a boost-typed pressure cylinder having a boost rod in the interior of a piston rod.

A further object of the present invention is to provide a method of forming snow into compression-solidified ice lumps to obtain an ice lump whose density is 0.6 g/cm$^3$ or more by changing the conditions of the pressure application.

According to the present invention, there is provided an apparatus for production of compression-solidified snow, which comprises a pressure chamber having a rust preventive inner face; a boost-typed pressure cylinder equipped with a pressure head for applying pressure to snow, the pressure cylinder being installed at one end of the pressure chamber; a hopper installed above the pressure chamber to throw snow into the pressure chamber, the hopper having an inner face which allows snow to slide thereon smoothly; and a pusher for discharging a compressed ice lump for the pressure chamber, the pusher being installed in a snow compression zone at the other end of the pressure chamber, wherein the hopper is vertically straight-shaped, the pressure face of the head of the pressure cylinder and the push face of the pusher being covered with a resin liner, and wherein water and air vents are provided in the snow compression zone of the pressure chamber.

Further, according to the present invention, there is provided a method for production of compression-solidified snow, in which the snow having a temperature ranging from 0° C. to −30° C. is compressed and formed with a pressure ranging from 10 to 200 kg/cm$^2$ at a rate of application of pressure ranging from 0.1 to 150 mm/sec for pressure holding time ranging from 0 to 300 seconds into a solid having a density of 0.6 g/cm$^3$ or more.

The aforesaid operation is implemented by the following method. Snow supplied from the hopper into the pressure chamber is pressed by the head of the pressure cylinder at one end of the pressure chamber.

The snow thus pressed is formed into an ice lump in the compression zone at the other end of the pressure chamber. Since the pressure chamber has a rust preventive inner face, rust is prevented from attaching to the snow thus pressed. The ice lump in the zone is discharged by the pusher from the pressure chamber.

The resin liners respectively applied to the face of the head of the pressure cylinder and the pushing face of the pusher facilitate the separation of the ice lump therefrom and besides, since the hopper is vertically straight-shaped but not funnel-shaped with an inner face allowing the snow to slide thereon smoothly, the snow thus thrown is caused to smoothly fall in.

The ice lump forced out of the pressure chamber by the pusher is free from moisture and air because of the water and air vents provided in the compression zone and the ice lump itself is utilizable as a thermal energy. Moreover, such ice lumps readily removable and dischargeable reduce work loads and minimize the snow discharging space.

The snow compressed under the aforesaid conditions can be formed into a lump having a density of 0.6 g/cm$^3$ or more and theoretically into an ice lump having a density of 0.917 g/cm$^3$. An ice lump having a density of 0.6 g/cm$^3$ or more is able to withstand mechanical transportation, utilizable as thermal energy, readily removable and dischargeable.

BRIEF DESCRIPTION OF THE DRAWINGS

FIG. 10 is a table showing the results of compression and solidification.

DESCRIPTION OF THE PREFERRED EMBODIMENTS

Figure 1:
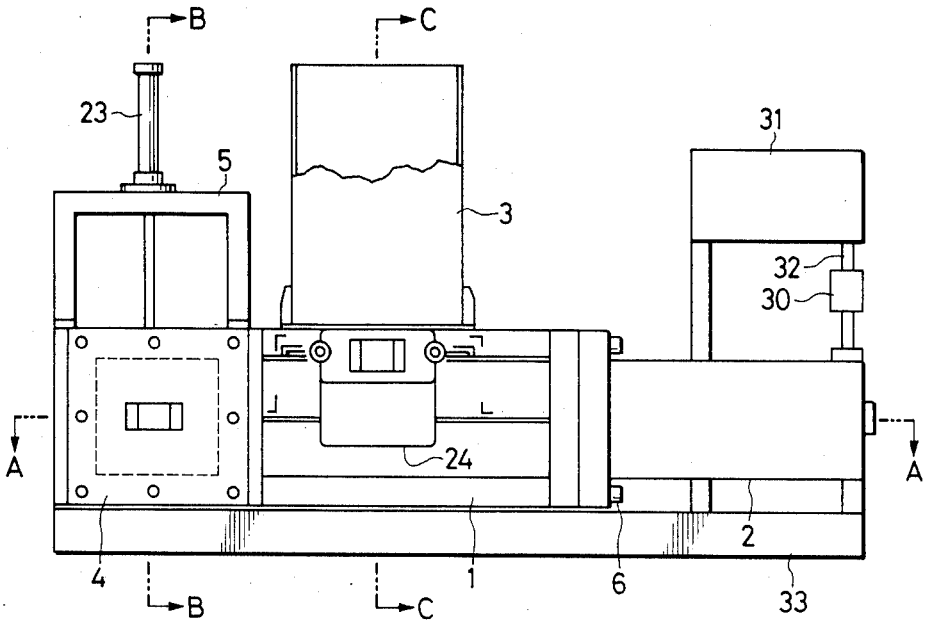
FIG. 1 is a side view of an apparatus according to an embodiment of the present invention.

The preferred embodiments of the present invention will be described with reference to the accompanying drawings.

As shown in FIGS. 1 through 4, a boost-type pressure cylinder 2 is equipped with a pressure head 7, a piston rod 7' and a boost rod 7'' installed in the interior of the piston rod 7', the piston rod 7' being fastened to the pressure head 7 with a connecting bolt 9 through a half ring 8.

A liner 10 is applied to the peripheral face of the head 7 to provide an optimum clearance between the peripheral face thereof and the inner face of a pressure chamber 1 having a square cross section, whereby the inner face thereof is prevented from being damaged. A resin liner 11 is applied to the pressing face of the head 7, so that snow 35 compressed into an ice lump 36 is readily separated therefrom.

Figure 4:
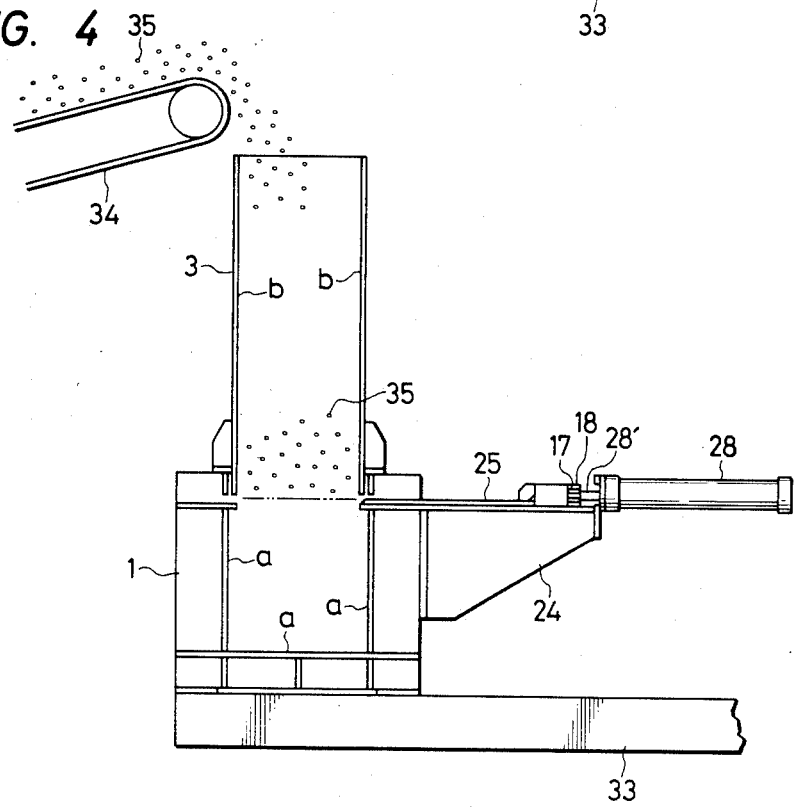
FIG. 4 is a sectional view taken on line C—C of FIG. 1.

The boost-typed pressure cylinder 2 is coupled to the pressure chamber 1 with a bolt 6. As shown in FIG. 1, a hopper 3 for supplying snow into the pressure chamber 1 is installed above the chamber 1. The hopper 3 is not funnel-shaped but vertically straight-shaped to make snow smoothly fall off. As shown in FIG. 4, a rust preventive stainless-clad steel plate is used for the inner face a of the pressure chamber 1 to prevent snow being compressed or an ice lump from bearing rust. The inner face b of the hopper 3 is coated with paint for increasing the sliding movement of snow.

The hopper 3 is provided with a hopper gate 25 for shutting the hopper 3 when snow is compressed, the hopper gate 25 being moved by a hopper gate cylinder 28. The front end of a piston rod 28' for the hopper gate cylinder 28 is coupled to the hopper gate 25 through a connector 17 and a loose coupling 18 to prevent the piston rod 28' from being broken.

Figure 2:
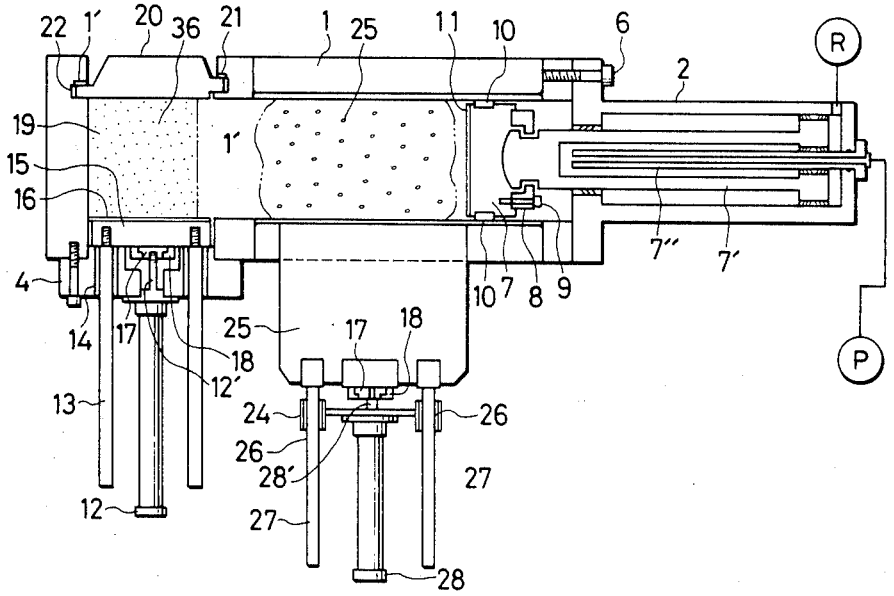
FIG. 2 is a sectional view taken on line A—A of FIG. 1.

As shown in FIG. 2, a guide rod 27 of the gate 25 is guided by an oil-impregnated bush 26 supported with a support frame 24. This guide is effective in preventing the hopper gate 25 from moving in zigzag because of the unbalanced load applied by the gate when the snow 25 is cut.

A pusher 15 is used to send out the ice lump 36 compressed by the pressure head 7 in the compression zone 19. The pushing face of the pusher 15 is provided with a resin liner 16 to improve the separation of the ice lump 36 therefrom.

A guide rod 13 of the pusher 15 is guided by an oil-impregnated bush 14 installed on a cover 4 fitted to the pressure chamber 1 with a coupling bolt 9'.

A pusher cylinder 12 is fitted to the cover 4 and the front end of a piston rod 12' thereof is coupled to the pusher 15 through the connector 17 and the loose coupling 18.

A gate 20 slides up and down along a guide groove 1' provided in the pressure chamber 1, whereas liners 21, 22 applied to both sides of the gate 20 help the gate 20 slide smoothly.

Figure 3:
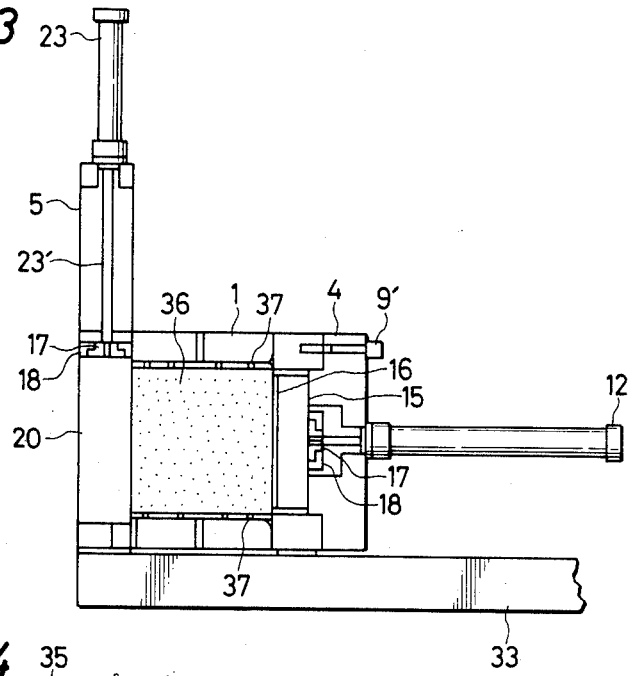
FIG. 3 is a sectional view taken on line B—B of FIG. 1.

As shown in FIG. 3, a gate cylinder 23 is fitted to a gate frame 5 and its piston rod 23' is coupled to the gate 20 through the connector 17 and the loose coupling 18.

An oil tank 31 for a hydraulic unit shown in FIG. 1 is coupled to the pressure cylinder 2 with a pipe 32 through a prefilling valve 30.

Water and air vents 37 shown in FIG. 3 are provided in the upper and lower faces of a compression zone of the pressure chamber 1 and a belt conveyer 34 shown in FIG. 4 is used to supply the snow 35 into the hopper 3.

A common base 33 shown in FIG. 1 is used to mount the equipment as a whole for convenience of transportation by a truck or operation thereof on the truck.

There is also installed a position detector (not shown) for causing each of the cylinders 2, 28, 12, 23 to operate sequentially.

The function of the apparatus will subsequently be described.

Snow is supplied by the belt conveyer 34 into the hopper 3. The hopper gate 25 is then shut and, by applying pressure to and actuating the boost-typed pressure cylinder 2, the snow 35 in the pressure chamber 1 is compressed by the head 7 with a pressure of 10 to 200 kg/cm$^2$. The snow 35 is consequently compressed into the ice lump 36 in the compression zone 19. The ice lump 36 should be solidified at a density of more than 0.6 g/cm$^3$.

The pressure in the pressure cylinder 2 is reduced and the gate 20 is opened, so that the ice lump 36 is forced out of the pressure chamber 1 by the pusher 15.

The ice lump 36 forced out of the pressure chamber 1 is transported by a truck to a destination.

A one-cycle process of the present invention ends by moving back the pressure head 7 and the pusher 15, moving the gate 20 down and opening the hopper gate 25 to let the snow 35 fall into the pressure chamber 1.

It has been so arranged that the apparatus according to the present invention is electrically controlled so as to automatically manufacture the ice lump 36 as far as the snow 35 is properly supplied by the hopper 3.

Figure 5:
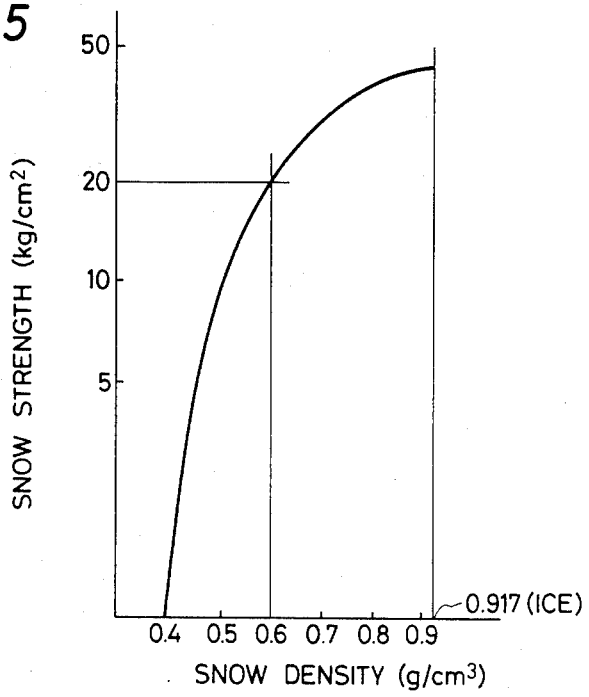
FIG. 5 is a graph showing the relationship between a snow density and a snow strength.

The lump 36 thus solidified by the aforesaid apparatus is made to have a density of 0.6 g/cm$^3$ or more and the lump having the density of 0.6 g/cm$^3$ is solid enough to be carried by a machine. More specifically, the relationship between the snow density and its strength as shown in FIG. 5 was obtained from the tests conducted. The snow has the strength of 20 kg/cm$^2$ while the density was set at 0.6 g/cm$^3$. Any ice lump having a strength of 20 kg/cm$^2$ or more may be conveyed by a machine without damage.

Figure 6:
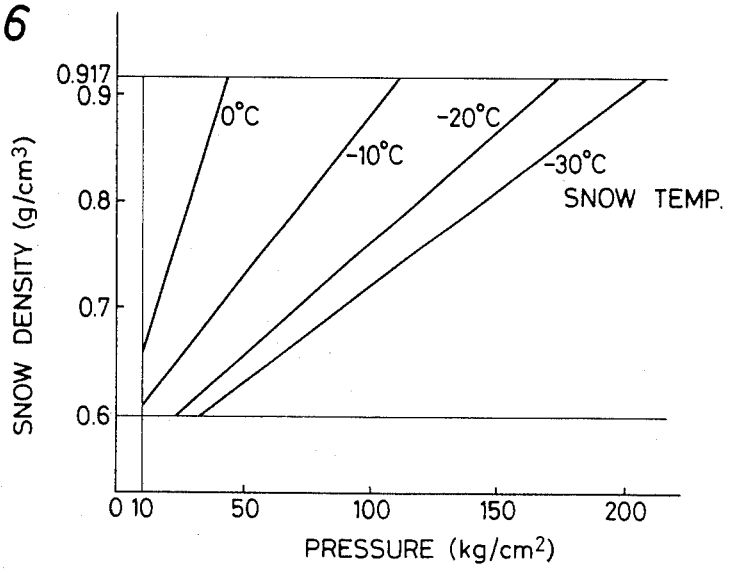
FIG. 6 is a graph showing the relationship between a pressure and a snow density.
Figure 7:
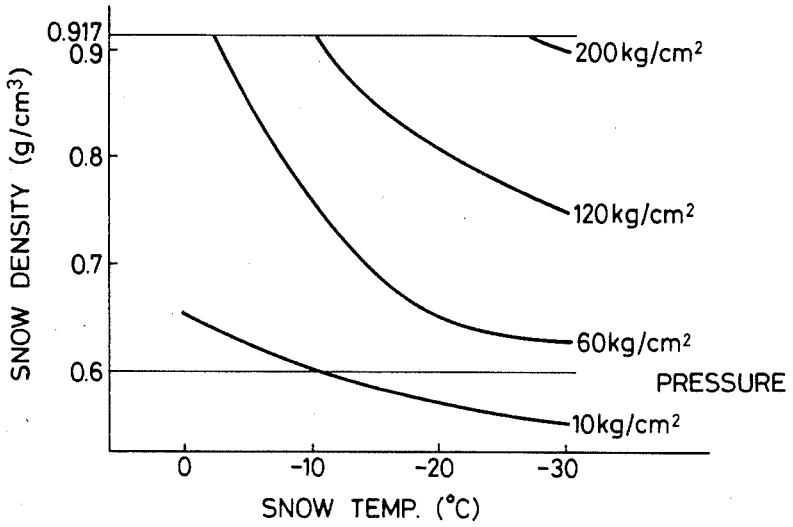
FIG. 7 is a graph showing the relationship between a snow temperature and a density.

The conditions under which an ice lump has a density of 0.6 g/cm$^3$ or more were discovered as follows: While the snow temperature was set at each of 0° C., −10° C., −20° C. and −30° C., each snow density corresponding to the pressure was obtained as shown in FIG. 6. As is obvious from FIG. 6, a lump having a density of 0.6 g/cm$^3$ or more is obtainable, provided the pressure is within the range of 10~200 kg/cm$^2$. FIG. 7 is a representation of the relationship between the snow temperature and density obtained from the results shown in FIG. 6.

Figure 8:
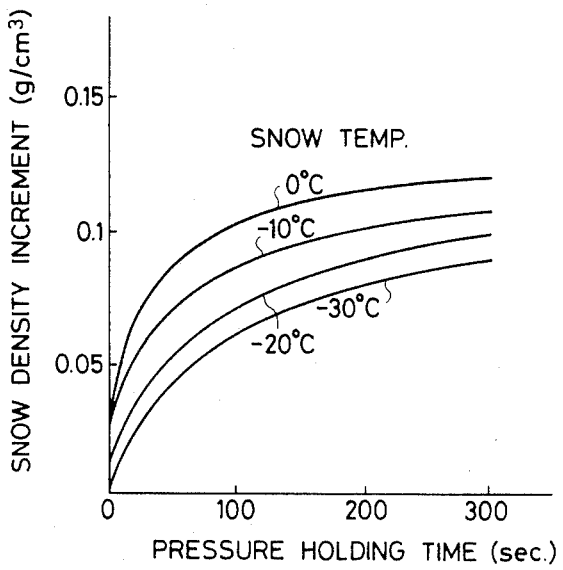
FIG. 8 is a graph showing the relationship between a pressure holding time and an increment in a snow density.

It was found that the density of the ice lump increased by holding the pressure. FIG. 8 shows the results thus observed. In consequence, the density was made to increase by about 0.08~0.12 g/cm$^3$ within the holding time for 300 seconds.

Figure 9:
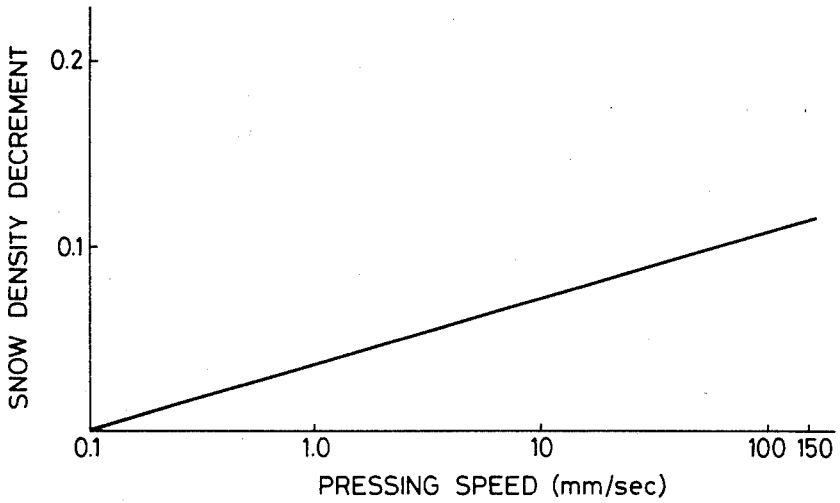
FIG. 9 is a graph showing the relationship between a rate of apllication of pressure and a decrease in a snow density.

Moreover, the relationship between the pressure speed (the forwarding speed of the pressure head 7) and the density was examined and proved that, as shown in FIG. 9, the density of the lump decreased as the pressure speed increased.

It is possible to obtain an ice lump whose density is equal to or more than 0.6 g/cm$^3$ under the following conditions: the snow temperature=0° to −30° C.; compression=10 to 200 kg/cm$^2$; rate of application of pressure=0.1 to 150 mm/sec; and pressure holding time=0~300 sec. Accordingly, the compression, the rate of application of pressure and the pressure holding time may be determined within the aforesaid range depending on the temperature of the snow supplied and the lump density required. In other words, the lower the snow temperature, the greater the compression should be applied. Moreover, the density can be increased by prolonging the pressure holding time and, by applying the pressure as slowly as possible, a lump having a high density may be obtained.

FIG. 10 shows the results obtained by changing the conditions of pressure application. The ice lumps of snow thus prepared passed rolling tests in which they were rolled on the ground and drop tests in which they were dropped from a place being at a high of 50 cm. Those lumps were not broken in the aforesaid tests and proved transportable instead.

Figure 11:
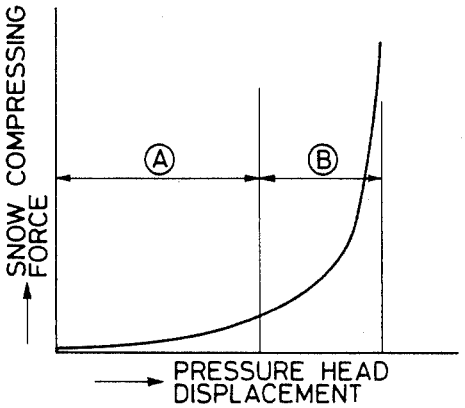
FIG. 11 is a graph showing the relationship between a pressure head displacement and a compression.

FIG. 11 shows the characteristic of the snow compression force and the pressure head displacement. The snow compression force required becomes large abruptly as the amount of the displacement of the pressure head increases in the zone of B shown in FIG. 11. In order to apply a suitable compression force corresponding to the characteristic curve to snow, the pressure head applies a low compression force to snow at high forwarding speed thereof in the zone of A, whereas the head applies a high compression force to snow at high forwarding speed thereof in the zone of A, whereas the head applies a high compression force to snow at a low forwarding speed thereof in the zone of B. The boost-typed cylinder equipped with the boost rod is used for alternatively changing a low compression force with a high head speed and a high compression force with a low head speed.

As a result, the snow can be compressed and solidified with a suitable compression force corresponding to the snow compression characteristic curve without the increases of a oil-pressure pump capacity and a motor capacity, thereby to improve the productivity.

The apparatus according to the present invention is designed to compress snow having an extremely large cubic volume into an ice lump, whereby it becomes possible to make snow mechanically transferable in a solid form, reduce the snow discharging space as well as snow removal and discharging cost to less than one-third of what is required conventionally, and find nearby dumping places; this results in reduction in transportation cost.

The thermal energy of snow offering least utility value can be made useful and snow also becomes utilizable as water resources.

Accordingly, the present invention has far-reaching effects on snowy countries.

Further, snow can efficiently be solidified because the snow having a temperature ranging from 0° to −30° C. is compressed and solidified under the following conditions: compression=10 to 200 kg/cm$^2$; rate of application of pressure=0.1 to 150 mm/sec; and pressure holding time=0 to 300 seconds. As a result, it becomes possible to utilize the thermal energy of snow, efficiently remove and discharge snow.

What is claimed is:

1. A method of compressing and solidifying snow, comprising the steps of:

supplying snow having a temperature ranging from 0° to −30° C. into a pressure chamber;

compressing the snow into solidified ice lump having a density of 0.6 g/cm$^3$ or more by a pressure head reciprocally movable within said pressure chamber under conditions of a pressure ranging from 10 to 200 kg/cm$^2$, a head displacement velocity ranging from 0.1 to 150 mm/sec and a pressure holding time ranging from 0 to 300 seconds; and discharging the solidified snow lump from said pressure chamber.

* * * * *